US012389937B2

(12) United States Patent
Malgat et al.

(10) Patent No.: US 12,389,937 B2
(45) **Date of Patent: *Aug. 19, 2025**

(54) AEROSOL-GENERATING ARTICLE

(71) Applicant: Philip Morris Products S.A., Neuchatel (CH)

(72) Inventors: Alexandre Malgat, Neuchatel (CH); Mirko Minzoni, Neuchatel (CH)

(73) Assignee: Philip Morris Products S.A., Neuchatel (CH)

( * ) Notice: Subject to any disclaimer, the term of this patent is extended or adjusted under 35 U.S.C. 154(b) by 70 days.

This patent is subject to a terminal disclaimer.

(21) Appl. No.: 17/305,291

(22) Filed: Jul. 2, 2021

(65) Prior Publication Data

US 2021/0321664 A1 Oct. 21, 2021

Related U.S. Application Data

(63) Continuation of application No. 16/082,337, filed as application No. PCT/EP2017/055379 on Mar. 8, 2017, now Pat. No. 11,083,213.

(30) Foreign Application Priority Data

Mar. 9, 2016 (EP) ..... 16159479

(51) Int. Cl.
*A24D 1/20* (2020.01)

(52) U.S. Cl.
CPC ..... *A24D 1/20* (2020.01)

(58) Field of Classification Search
CPC ..... A24D 1/20
See application file for complete search history.

(56) References Cited

U.S. PATENT DOCUMENTS 5,808,281 A * 9/1998 Matsen ..... B29C 70/506 219/645
2014/0305448 A1 10/2014 Zuber et al.
2014/0373856 A1 12/2014 Zuber et al.

FOREIGN PATENT DOCUMENTS

CN 103987286 A 8/2014
CN 104010531 A 8/2014
CN 204888733 U 12/2015
(Continued)

OTHER PUBLICATIONS

Korean Notice of Allowance issued May 25, 2022 in Korean Patent Application No. 10-2018-7028674 (with English language translation), 3 pages.

(Continued)

*Primary Examiner* — Christopher M Rodd
*Assistant Examiner* — Jennifer A Kessie
(74) *Attorney, Agent, or Firm* — Oblon, McClelland, Maier & Neustadt, L.L.P.

(57) ABSTRACT

An aerosol-generating article is provided, including: a plurality of elements assembled in the form of a rod having a mouth end and a distal end upstream from the mouth end, the plurality of elements including an aerosol-forming substrate with an elongate susceptor arranged longitudinally within the aerosol-forming substrate, a plug element being located upstream of and adjacent the aerosol-forming substrate within the rod, the plug element preventing direct physical contact with a distal end of the elongate susceptor arranged longitudinally within the aerosol-forming substrate.

21 Claims, 1 Drawing Sheet

(56) References Cited

FOREIGN PATENT DOCUMENTS

| | | | |
|---|---|---|---|
| CN | 108601407 | | 12/2021 |
| JP | 3012253 | B2 | 2/2000 |
| JP | 2016-524777 | A | 8/2016 |
| JP | 2016-525341 | A | 8/2016 |
| JP | 2016-538850 | A | 12/2016 |
| JP | 3227591 | U | 9/2020 |
| KR | 100449444 | B1 | 8/2005 |
| KR | 10-2014-0119063 | A | 10/2014 |
| KR | 10-2015-0143885 | A | 12/2015 |
| KR | 10-2015-0144816 | A | 12/2015 |
| KR | 10-2016-0094938 | A | 8/2016 |
| RU | 2014 131 469 | A | 12/2012 |
| TW | 201544022 | A | 12/2015 |
| WO | WO 96/32854 | A2 | 10/1996 |
| WO | 2013/098405 | A2 | 7/2013 |
| WO | 2013/098409 | A1 | 7/2013 |
| WO | 2013/098410 | A2 | 7/2013 |
| WO | WO 2013/098411 | A1 | 7/2013 |
| WO | 2014/158051 | A1 | 10/2014 |
| WO | 2015/082651 | A1 | 6/2015 |
| WO | WO 2015/082650 | A1 | 6/2015 |
| WO | 2015/176898 | A1 | 11/2015 |
| WO | 2015/177255 | A1 | 11/2015 |
| WO | 2015/177294 | A1 | 11/2015 |
| WO | WO 2015/177256 | A1 | 11/2015 |
| WO | WO 2015/177265 | A1 | 11/2015 |
| WO | WO 2017/068095 | A1 | 4/2017 |
| WO | WO 2017/149093 | A1 | 9/2017 |

OTHER PUBLICATIONS

Combined Chinese Office Action and Search Report issued on Sep. 24, 2020, in Patent Application No. 201780009458.5 (with English translation)(18 pages).

Combined Taiwanese Office Action and Search Report issued May 18, 2020 in Patent Application No. 106107489 (with English language translation)(12 pages).

PCT Search Report and Written Opinion for PCT/EP2017/055379 dated May 24, 2017 (12 pages).

Office Action issued in Russia for Application No. 2018135295 dated Mar. 20, 2020 (12 pages). English translation included.

Korean Notice of Allowance issued Oct. 26, 2023 in Korean Patent Application No. 10-2022-7029223 (with English Translation), 5 pages.

Japanese Notice of Allowance issued Oct. 3, 2024 in Japanese Patent Application No. 2024-026702, 2 pages.

Notice of Allowance dated Apr. 14, 2025, issued in corresponding Japanese patent application No. 2024-180274.

Notification for Accepting the Request for Invalidation dated May 22, 2025 issued in corresponding Chinese Patent Application No. 201780009458.5.

* cited by examiner

AEROSOL-GENERATING ARTICLE

CROSS-REFERENCE TO RELATED APPLICATIONS

This application is a continuation of and claims priority to U.S. patent application Ser. No. 16/082,337, filed Sep. 5, 2018, the entire contents of which are incorporated herein by reference. Application Ser. No. 16/082,337 is a National Stage Application of International Application No. PCT/EP2017/055379, filed Mar. 8, 2017, which claims priority to European Patent Application No. 16159479.1, filed Mar. 9, 2016. The benefit of priority is claimed to each of the foregoing.

BACKGROUND

The invention relates to aerosol-generating articles comprising an aerosol-forming substrate and an elongate susceptor arranged in the aerosol-forming substrate. In particular, the invention relates to inductively heatable aerosol-generating articles.

From prior art inductively heatable aerosol-generating articles comprising an aerosol-forming substrate and an elongate susceptor arranged in the aerosol-forming substrate are known. For example, the international patent publication WO 2015/176898 discloses an aerosol-generating article having an elongate susceptor arranged in an aerosol-forming substrate plug. The aerosol-generating article comprises a plurality of elements in the form of a rod and is adapted to be used in an electrically operated aerosol-generating device comprising an inductor for generating heat in the elongate susceptor. The position of the elongate susceptor may depend on the manufacturing method of the aerosol-forming substrate comprising the susceptor. However, the elongate susceptor typically extends at least to a distal end of the aerosol-forming substrate plug. This exposed position of at least an end portion of the susceptor may alter a consistency of the article due to a possible shift in position of the susceptor during handling or transport of the article.

It would therefore be desirable to have an aerosol-generating article comprising an aerosol-forming substrate and an elongate susceptor arranged in the aerosol-forming substrate providing improved consistency of the article.

BRIEF SUMMARY

According to the invention there is provided an aerosol-generating article comprising a plurality of elements assembled in the form of a rod having a mouth end and a distal end upstream from the mouth end. The plurality of elements comprises an aerosol-forming substrate with an elongate susceptor arranged longitudinally within the aerosol-forming substrate. A plug element is located upstream of and adjacent the aerosol-forming substrate within the rod. The plug element prevents direct physical contact with a distal end of the elongate susceptor arranged longitudinally within the aerosol-forming substrate.

The plug element prevents direct contact with the distal end of the susceptor and thus may prevent a displacement or a deformation of the susceptor during handling or transport of the article. The susceptor typically being a metal component and comparatively heavy tends to fall out of the aerosol-forming substrate upon transport of the article. Thus, the plug element may also prevent a falling out of the susceptor from the aerosol-generating article, for example if the susceptor becomes dislodged during transport of the article. A further advantage of a plug element protecting the distal end of the aerosol-forming substrate may be of an aesthetic or branding reason. A plug element may be used to cover the distal end of the article. It may give the distal end of the article a pleasant appearance. It may also provide information on the article, for example, on brand, content, flavour, or an electronically operated device the article is to be used with.

A plug element may secure form and position of the susceptor in the aerosol-forming substrate and thus may improve or guarantee an article-to-article consistency. In addition, a plug element preferably also improves an aesthetic appearance of the article and may provide simple measures to provide further information on the article to a user.

As used herein, the terms 'upstream' and 'downstream' are used to describe the relative positions of elements, or portions of elements, of the aerosol-generating article in relation to the direction in which a user draws on the aerosol-generating article during use thereof. The aerosol-generating article is in the form of a rod that comprises two ends: a mouth end, or proximal end, through which aerosol exits the aerosol-generating article and is delivered to a user, and a distal end. In use, a user may draw on the mouth end. The distal end may also be referred to as the upstream end and is upstream of the mouth end.

Preferably, the aerosol-generating article is a smoking article that generates an aerosol. More, preferably, the aerosol-generating article is a smoking article that generates a nicotine-containing aerosol.

The plug element may be a porous element. Preferably, a porous plug element does not alter a resistance to draw of the aerosol-generating article. Preferably, the plug element has a porosity of at least 50 percent in the longitudinal direction of the rod. Preferably, the plug element has a porosity between 50 percent and 90 percent. The porosity of the plug element in the longitudinal direction is defined by the ratio of the cross-sectional area of material forming the plug element and the internal cross-sectional area of the aerosol-generating article at the position of the plug element. This porosity definition also applies to any other element of the aerosol-generating article accordingly.

The plug element may be made of a porous material or may comprise a plurality of openings. This may, for example, be achieved through laser perforations.

Permeability of a plug element may allow a user to draw air through the rod via the plug element.

Preferably, the plurality of openings is distributed homogeneously over the cross-section of the plug element.

Preferably, the sizes of the openings of the plurality of openings do not allow view onto the distal end of the aerosol-forming substrate.

Porosity or permeability of the plug element may be varied to support control of a resistance to draw through the aerosol-generating article.

A resistance to draw (RTD) of a plug element may be between 20 mmWG and 40 mmWG, preferably between 25 mmWG and 35 mmWG (millimeter water gauge). Preferably, a RTD of the plug element does not exceed 30 mmWG. Preferably, a resistance to draw (RTD) of the plug element is between 1 to 5 mmWG per millimeter length of the plug element, for example 2.5 mmWG per mm length of the plug element. The plug element may have a same RTD as an element made of the aerosol-forming substrate comprising the elongate susceptor.

Alternatively, the plug element may be gas-tight and may be formed from a material that is not permeable to air. In such embodiments, the article may be configured such that air flows into the rod through a sidewall, for example through a cigarette paper or pores defined in a wrapper material.

The plug element may be made of any material suitable for use in an aerosol-generating article for inductively heatable aerosol-generating devices. The plug element may, for example, be made of a same material as used in the article, for example of a same material as used in a conventional mouthpiece filter, in an aerosol-cooling element or in a support element. Exemplary materials are filter materials, ceramic, polymeric material, cellulose acetate, cardboard, non-inductively heatable metal, zeolite, or aerosol-forming substrate.

Preferably, the plug element is made of a heat resistant material. Heat resistant material for the plug element is herein meant that the plug element may resist temperatures of up to about 350 degree Celsius. By this, the plug element is preferably not affected by the heated susceptor or heated aerosol-forming substrate.

Preferably, the plug element does not change its consistency, geometry or optics upon use of the article.

Preferably, the plug element does not generate additional substances to the generated aerosol during use of the article.

The plug element has a diameter that is approximately equal to a diameter of the aerosol-generating article. Preferably, the plug element has a diameter between 5 millimeter and 10 millimeter. It is preferable that the diameter of the plug is greater than 5 mm, for example between 6 mm and 8 mm. The plug element has a length that may be defined as the dimension along the longitudinal axis of the aerosol-generating article. The length of the plug element may be between 1 millimeter and 10 millimeter, for example between 4 mm and 8 mm or between 5 mm and 7 mm. It is preferred that the plug element is substantially cylindrical. Preferably, a plug element is smaller than 8 mm. It is preferred that the plug element has a length of at least 2 millimeter in order to facilitate assembly of an aerosol-generating article, preferably at least 3 millimeter or at least 5 millimeter.

As a general rule, whenever a value is mentioned throughout this application, this is to be understood such that the value is explicitly disclosed. However, a value is also to be understood as not having to be exactly the particular value due to technical considerations.

The plug element may be a separate element. The above given minimum sizes of the length of the plug element facilitate or allow use of conventional combiners to assemble the plurality of elements to a rod shape.

The plug element may have a homogeneous structure. The plug element may for example be homogeneous in texture and appearance. The plug element may, for example, have a continuous, regular surface over its entire cross section or, for example, have no recognizable symmetries. Preferably, at least the distal end of the plug element has a homogeneous structure. A homogeneous distal end of the plug element favours a consistency of the plug element over the entire cross section of the article.

The plug element may comprise an inner surface defining a cavity, the cavity preferably located at least at a proximal end of the plug element. The cavity directs versus the aerosol-forming substrate. The cavity is arranged within the plug element such that the plug element does not or over a limited area only contact the elongate susceptor arranged within the aerosol-forming substrate. The cavity may be arranged centrally within the plug element such that a center portion of the proximal end of the plug element does not contact the elongate susceptor. The inner surface of the cavity may, for example, have a concave shape, for example be dome-shaped. Preferably, a diameter of the cavity in a radial direction of the rod is larger than a radial extension of the elongate susceptor.

Providing a cavity in the plug element such that the plug element does not physically contact the susceptor and generally limiting a contact area between plug element and aerosol-forming substrate may prevent extensive heating of the plug element, in particular of those parts of the plug element in contact with the susceptor. This may reduce the risk of overheating or charring the plug element and widen the choice of materials suitable in the manufacture of plug elements.

The aerosol-forming substrate may be a solid aerosol-forming substrate. The aerosol-forming substrate may comprise a tobacco-containing material containing volatile tobacco flavour compounds, which are released from the substrate upon heating. Alternatively, the aerosol-forming substrate may comprise a non-tobacco material. The aerosol-forming substrate may further comprise an aerosol former. Examples of suitable aerosol formers are glycerine and propylene glycol.

If the aerosol-forming substrate is a solid aerosol-forming substrate, the solid aerosol-forming substrate may comprise, for example, one or more of: powder, granules, pellets, shreds, spaghetti strands, strips or sheets containing one or more of: herb leaf, tobacco leaf, fragments of tobacco ribs, reconstituted tobacco, homogenised tobacco, extruded tobacco and expanded tobacco. The solid aerosol-forming substrate may be in loose form, or may be provided in a suitable container or cartridge. For example, the aerosol-forming material of the solid aerosol-forming substrate may be contained within a paper or other wrapper and have the form of a plug. Where an aerosol-forming substrate is in the form of a wrapped plug, the entire plug including any wrapper is considered to be the aerosol-forming substrate.

Optionally, the solid aerosol-forming substrate may contain additional tobacco or non-tobacco volatile flavour compounds, to be released upon heating of the solid aerosol-forming substrate. The solid aerosol-forming substrate may also contain capsules that, for example, include the additional tobacco or non-tobacco volatile flavour compounds and such capsules may melt during heating of the solid aerosol-forming substrate.

The aerosol-forming substrate may comprise one or more sheets of homogenised tobacco material that has been gathered into a rod, circumscribed by a wrapper, and cut to provide individual plugs of aerosol-forming substrate. Preferably, the aerosol-forming substrate comprises a crimped and gathered sheet of homogenised tobacco material.

Preferably, the aerosol-forming tobacco substrate is a tobacco sheet, preferably crimped, comprising tobacco material, fibers, binder and aerosol former. Preferably, the tobacco sheet is a cast leaf. Cast leaf is a form of reconstituted tobacco that is formed from a slurry including tobacco particles, fiber particles, aerosol former, binder and for example also flavours.

A wrapper may be any suitable non-tobacco material for wrapping elements of an aerosol-generating article in the form of a rod. The wrapper holds the plurality of elements within the aerosol-generating article when the article is assembled into a rod.

The aerosol-forming substrate may be substantially cylindrical in shape. The aerosol-forming substrate may be substantially elongate. The aerosol-forming substrate may also have a length and a circumference substantially perpendicular to the length.

Further, the aerosol-forming substrate may have a length of 10 millimeter. Alternatively, the aerosol-forming substrate may have a length of 12 millimeter. Further, the diameter of the aerosol-forming substrate may be between 5 millimeter and 12 millimeter.

As used herein, the term 'susceptor' refers to a material that can convert electromagnetic energy into heat. When located within a fluctuating electromagnetic field, eddy currents induced in the susceptor cause heating of the susceptor. As the elongate susceptor is located in thermal contact with the aerosol-forming substrate, the aerosol-forming substrate is heated by the susceptor. The susceptor has a length dimension that is greater than its width dimension or its thickness dimension, for example greater than twice its width dimension or its thickness dimension. Thus the susceptor may be described as an elongate susceptor. The susceptor is arranged substantially longitudinally within the rod. This means that the length dimension of the elongate susceptor is arranged to be approximately parallel to the longitudinal direction of the rod, for example within plus or minus 10 degrees of parallel to the longitudinal direction of the rod. In preferred embodiments, the elongate susceptor may be positioned in a radially central position within the rod, and extends along the longitudinal axis of the rod.

The susceptor is preferably in the form of a pin, rod, strip or blade. The susceptor preferably has a length of between 5 millimeter and 15 millimeter, for example between 6 mm and 12 mm, or between 8 mm and 10 mm. The susceptor preferably has a width of between 1 mm and 5 mm and may have a thickness of between 0.01 mm and 2 mm, for example between 0.5 mm and 2 mm. In a preferred embodiment the susceptor may have a thickness of between 10 micrometer and 500 micrometer, or even more preferably between 10 and 100 micrometer. If the susceptor has a constant cross-section, for example a circular cross-section, it has a preferable width or diameter of between 1 millimeter and 5 millimeter. If the susceptor has the form of a strip or blade, the strip or blade preferably has a rectangular shape having a width preferably between 2 millimeter and 8 millimeter, more preferably, between 3 millimeter and 5 millimeter, for example 4 millimeter and a thickness preferably between 0.03 millimeter and 0.15 millimeter, more preferably between 0.05 millimeter and 0.09 millimeter, for example 0.07 millimeter.

Preferably, the elongate susceptor has a length which is the same or shorter than the length of the aerosol-forming substrate. Preferably, the elongate susceptor has a same length as the aerosol-forming substrate.

The susceptor may be formed from any material that can be inductively heated to a temperature sufficient to generate an aerosol from the aerosol-forming substrate. Preferred susceptors comprise a metal or carbon. A preferred susceptor may comprise or consist of a ferromagnetic material, for example a ferromagnetic alloy, ferritic iron, or a ferromagnetic steel or stainless steel. A suitable susceptor may be, or comprise, aluminium. Preferred susceptors may be formed from 400 series stainless steels, for example grade 410, or grade 420, or grade 430 stainless steel. Different materials will dissipate different amounts of energy when positioned within electromagnetic fields having similar values of frequency and field strength. Thus, parameters of the susceptor such as material type, length, width, and thickness may all be altered to provide a desired power dissipation within a known electromagnetic field.

Preferred susceptors may be heated to a temperature in excess of 250 degrees Celsius. Suitable susceptors may comprise a non-metallic core with a metal layer disposed on the non-metallic core, for example metallic tracks formed on a surface of a ceramic core. A susceptor may have a protective external layer, for example a protective ceramic layer or protective glass layer encapsulating the susceptor. The susceptor may comprise a protective coating formed by a glass, a ceramic, or an inert metal, formed over a core of susceptor material.

The susceptor is arranged in thermal contact with the aerosol-forming substrate. Thus, when the susceptor heats up the aerosol-forming substrate is heated up and an aerosol is formed. Preferably the susceptor is arranged in direct physical contact with the aerosol-forming substrate, for example within the aerosol-forming substrate.

The susceptor may be a multi-material susceptor and may comprise a first susceptor material and a second susceptor material. The first susceptor material is disposed in intimate physical contact with the second susceptor material. The second susceptor material preferably has a Curie temperature that is lower than 500° C. The first susceptor material is preferably used primarily to heat the susceptor when the susceptor is placed in a fluctuating electromagnetic field. Any suitable material may be used. For example the first susceptor material may be aluminium, or may be a ferrous material such as a stainless steel. The second susceptor material is preferably used primarily to indicate when the susceptor has reached a specific temperature, that temperature being the Curie temperature of the second susceptor material. The Curie temperature of the second susceptor material can be used to regulate the temperature of the entire susceptor during operation. Thus, the Curie temperature of the second susceptor material should be below the ignition point of the aerosol-forming substrate. Suitable materials for the second susceptor material may include nickel and certain nickel alloys.

By providing a susceptor having at least a first and a second susceptor material, with either the second susceptor material having a Curie temperature and the first susceptor material not having a Curie temperature, or first and second susceptor materials having first and second Curie temperatures distinct from one another, the heating of the aerosol-forming substrate and the temperature control of the heating may be separated. The first susceptor material is preferably a magnetic material having a Curie temperature that is above 500° C. It is desirable from the point of view of heating efficiency that the Curie temperature of the first susceptor material is above any maximum temperature that the susceptor should be capable of being heated to. The second Curie temperature may preferably be selected to be lower than 400° C., preferably lower than 380° C., or lower than 360° C. It is preferable that the second susceptor material is a magnetic material selected to have a second Curie temperature that is substantially the same as a desired maximum heating temperature. That is, it is preferable that the second Curie temperature is approximately the same as the temperature that the susceptor should be heated to in order to generate an aerosol from the aerosol-forming substrate. The second Curie temperature may, for example, be within the range of 200° C. to 400° C., or between 250° C. and 360° C. The second Curie temperature of the second susceptor material may, for example, be selected such that, upon being heated by a susceptor that is at a temperature equal to the second Curie temperature, an overall average temperature of the aerosol-forming substrate does not exceed 240° C.

The aerosol-generating article may be substantially cylindrical in shape. The aerosol-generating article may be substantially elongate. The aerosol-generating article may have a length and a circumference substantially perpendicular to the length.

The aerosol-generating article may have a total length between 30 millimeter and 100 millimeter. In preferred embodiments, the aerosol-generating article has a total length of between 40 mm and 55 mm, for example 47-53 mm.

The aerosol-generating article may have an external diameter between 5 millimeter and 12 millimeter, for example of between 6 mm and 8 mm. In a preferred embodiment, the aerosol-generating article has an external diameter of 7.2 mm plus or minus 10 percent.

The aerosol-generating article may comprise a mouthpiece element. The mouthpiece element may be located at the mouth end or downstream end of the aerosol-generating article.

The mouthpiece element may comprise at least one filter segment. The filter segment may be a cellulose acetate filter plug made of cellulose acetate tow. A filter segment may have low particulate filtration efficiency or very low particulate filtration efficiency. A filter segment may be longitudinally spaced apart from the aerosol-forming substrate. The filter segment is 7 millimeter in length in one embodiment, but may have a length of between 5 millimeter and 14 millimeter.

A mouthpiece element is the last portion in the downstream direction of the aerosol-generating article. A user contacts the mouthpiece element in order to pass an aerosol generated by the aerosol-generating article though the mouthpiece element to the user. Thus, a mouthpiece element is arranged downstream of an aerosol-forming substrate.

The mouthpiece element preferably has an external diameter that is approximately equal to the external diameter of the aerosol-generating article. The mouthpiece element may have an external diameter of between 5 millimeter and 10 millimeter, for example of between 6 mm and 8 mm. In a preferred embodiment, the mouthpiece element has an external diameter of 7.2 mm plus or minus 10 percent. The mouthpiece element may have a length of between 5 millimeter and 25 millimeter, preferably a length of between 10 mm and 17 mm. In a preferred embodiment, the mouthpiece element has a length of 12 mm or 14 mm. In another preferred embodiment, the mouthpiece element has a length of 7 mm.

The aerosol-generating article may comprise a support element that may be located immediately downstream of the aerosol-forming substrate and may abut the aerosol-forming substrate.

The support element may be formed from any suitable material or combination of materials. For example, the support element may be formed from one or more materials selected from the group consisting of: cellulose acetate; cardboard; crimped paper, such as crimped heat resistant paper or crimped parchment paper; and polymeric materials, such as low density polyethylene (LDPE). In a preferred embodiment, the support element is formed from cellulose acetate.

The support element may comprise a hollow tubular element. In a preferred embodiment, the support element comprises a hollow cellulose acetate tube.

The support element preferably has an external diameter that is approximately equal to the external diameter of the aerosol-generating article.

The support element may have an external diameter of between 5 millimeter and 12 millimeter, for example of between 5 mm and 10 mm or of between 6 mm and 8 mm. In a preferred embodiment, the support element has an external diameter of 7.2 mm plus or minus 10 percent. The support element may have a length of between 5 millimeter and 15 millimeter. In a preferred embodiment, the support element has a length of 8 mm.

The aerosol-generating article may comprise an aerosol-cooling element. The aerosol-cooling element may be located downstream of the aerosol-forming substrate, for example an aerosol-cooling element may be located immediately downstream of a support element, and may abut the support element.

The aerosol-cooling element may be located between the support element and a mouthpiece element located at the extreme downstream end of the aerosol-generating article.

As used herein, the term 'aerosol-cooling element' is used to describe an element having a large surface area and a low resistance to draw. In use, an aerosol formed by volatile compounds released from the aerosol-forming substrate is drawn through the aerosol-cooling element before being transported to the mouth end of the aerosol-generating article. In contrast to high resistance-to-draw filters, for example filters formed from bundles of fibers, aerosol-cooling elements have a low resistance to draw. Chambers and cavities within an aerosol-generating article such as expansion chambers and support elements are also not considered to be aerosol cooling elements.

An aerosol-cooling element preferably has a porosity in a longitudinal direction of greater than 50 percent. The airflow path through the aerosol-cooling element is preferably relatively uninhibited. An aerosol-cooling element may be a gathered sheet or a crimped and gathered sheet. An aerosol-cooling element may comprise a sheet material selected from the group consisting of polyethylene (PE), polypropylene (PP), polyvinylchloride (PVC), polyethylene terephthalate (PET), polylactic acid (PLA), cellulose acetate (CA), and aluminium foil or any combination thereof.

In a preferred embodiment, the aerosol-cooling element comprises a gathered sheet of biodegradable material. For example, a gathered sheet of non-porous paper or a gathered sheet of biodegradable polymeric material, such as polylactic acid or a grade of Mater-Bi<®> (a commercially available family of starch based copolyesters).

An aerosol-cooling element preferably comprises a sheet of PLA, more preferably a crimped, gathered sheet of PLA. An aerosol-cooling element may be formed from a sheet having a thickness of between 10 micrometer and 250 micrometer, for example 50 micrometer. An aerosol-cooling element may be formed from a gathered sheet having a width of between 150 millimeter and 250 millimeter. An aerosol-cooling element may have a specific surface area of between 300 millimeter$^2$ per millimeter length and 1000 millimeter$^2$ per millimeter length between 10 millimeter$^2$ per mg weight and 100 millimeter$^2$ per mg weight. In some embodiments, the aerosol-cooling element may be formed from a gathered sheet of material having a specific surface area of about 35 millimeter$^2$ per mg weight. An aerosol-cooling element may have an external diameter of between 5 millimeter and 10 millimeter, for example 7 mm.

In some preferred embodiments, the length of the aerosol-cooling element is between 10 millimeter and 15 millimeter. Preferably, the length of the aerosol-cooling element is between 10 millimeter and 14 millimeter, for example 13 millimeter.

In alternative embodiments, the length of the aerosol-cooling element is between 15 millimeter and 25 millimeter. Preferably, the length of the aerosol-cooling element is between 16 millimeter and 20 millimeter, for example 18 millimeter.

As the aerosol passes thorough the aerosol-cooling element, the temperature of the aerosol is reduced due to transfer of thermal energy to the aerosol-cooling element. Furthermore, water droplets may condense out of the aerosol and adsorb to the material of the aerosol-cooling element. Depending on the type of material forming the aerosol-cooling element, a water content of the aerosol may be reduced from anywhere between 0 percent and 90 percent. For example, when the aerosol-cooling element is comprised of polylactic acid, the water content is not considerably reduced. For example, when starch based material, for example such as Mater-Bi, is used to form the aerosol-cooling element, a water reduction may be about 40 percent. Accordingly, through selection of the material comprising the aerosol-cooling element, the water content in the aerosol may be chosen.

Aerosol formed by heating for example a tobacco-based aerosol-forming substrate, will typically comprise phenolic compounds. An aerosol-cooling element may reduce levels of phenol and cresols by 90 percent to 95 percent.

Commonly available electronic heating devices are designed for use of aerosol-generating articles of predefined dimensions, in particular of a predefined standard length. In order for aerosol-generating articles to be usable with these standard heating devices, a total length of an aerosol-generating article should have a standard length. Typically, such a standard length is 45 millimeter. In addition, dimensions and arrangement of an aerosol-forming substrate comprised in the aerosol-generating article, which substrate is heated by a heating element of the heating device, is preferably kept unchanged.

Thus, if a plug element is added to an aerosol-generating device, the length of the article becomes longer by the length of the plug element. Thus, a length of the plug element should not exceed a length of 8 mm in order not to overly extend the overall length of the aerosol-generating article. Preferably, an aerosol-generating article having a standard length of 45 mm becomes an article having a length of between 47 mm to 53 mm when provided with a plug element.

However, the length of the article may also be kept constant by compensating the added length of the plug element through shortening another element or segment of the article, preferably of an aerosol-cooling element. However, upon doing so, the specifics of the article shall preferably not be altered.

Experiments have shown that a desired aerosol cooling or reduction in phenolic compounds may be achieved also in aerosol-cooling elements having a length shorter than the standard 18 millimeter aerosol-cooling elements in standard length aerosol-generating article. In particular, no lesser cooling or different smoke chemistry has been found in shorter aerosol-cooling elements made of polylactic acid.

Thus, the additional length of the plug element may be compensated by a shortening of the aerosol cooling element. A shortening of the aerosol-cooling element, or an additional shortening of the aerosol-cooling element may also be done by the provision of a hollow tube.

Some of the materials used in aerosol-generating articles are also more cost relevant than others. For example, the materials used for an aerosol-cooling element, in particular crimped polylactic acid sheets, are costly. Thus, in the aerosol-generating article, the length of the aerosol-cooling element may be reduced compared to such an element in a standard aerosol-generating article for electronic devices. Typically, a standard length of an aerosol-cooling element is 18 millimeter. In order to maintain a total length of the aerosol-generating article at a predefined length, for example at 45 millimeter, the length of the mouthpiece element may be extended to make up for the shorter aerosol-cooling element.

It has been surprising to find that the aerosol-cooling element may be shortened to a certain extent without negatively affecting smoke chemistry. It has also been surprising to find that if the length difference is compensated in the mouthpiece, this may be done without altering a transfer of smoke constituents though the mouthpiece. In particular, no alteration of smoke constituents by the mouthpiece have been detected if a hollow tube is used for total length compensation. A shortening of the aerosol-cooling element by only a few millimeter has shown to lead to significant cost reduction. Preferably, an extension of the mouthpiece is realized by the provision of a hollow tube. A hollow tube, for example a cardboard tube, may be manufactured at very low cost, such that cost savings may be achieved with a partial "replacement" of the aerosol-cooling element in the tobacco part of the aerosol-generating article by a hollow tube in the mouthpiece part of the aerosol-generating article.

Thus, the mouthpiece element may comprise a hollow tube.

Preferably, the hollow tube, if present, is arranged at the downstream end of the mouthpiece element and thus at the downstream end of the aerosol-generating article. By this, the effect of a recessed filter is given to the aerosol-generating article. Thus, a haptic sensation may be offered to customers when using an electronic smoking system, which haptic sensation is equal to the one they may be used to from smoking conventional cigarettes provided with recessed filters.

A hollow tube of a mouthpiece element may be made of cardboard. The hollow tube may also be made of different material, for example paper or thin plastics sheet material. Preferably, the hollow tube has a stability that allows for handling the aerosol-generating article.

The length of the hollow tube may be between 3 millimeter and 8 millimeter. Preferably, the length of the hollow tube is 5 millimeter.

The above mentioned lengths of hollow tubes, in particular of cardboard tubes, have shown to enable good manufacturing of the tubes as well as good handling of the tubes upon assembly of the mouthpiece element and of the aerosol-generating article.

Preferably, a wall thickness of the hollow tube is between 100 micrometer and 300 micrometer, for example 200 micrometer. When inserting an aerosol-generating article into an electronic heating device a consumer typically holds the article at its proximal end or pushes the article at its proximal end. Thus, the article is typically pushed at the hollow tube since the hollow tube is preferably the most proximal segment of the article. The above mentioned wall thicknesses have shown to suffice stability requirements for hollow tubes, in particular of cardboard tubes, when the aerosol-generating article is inserted into the electronic heating device.

An aerosol-generating article according to the invention preferably comprises a plug element, an aerosol-forming substrate containing the susceptor, a support element, an aerosol-cooling element and a mouthpiece element. The mouthpiece element comprises at least one filter element and may optionally comprise a hollow tube. In such aerosol-generating articles the support element is arranged downstream of the aerosol-forming substrate and the aerosol-cooling element is arranged downstream of the support element.

In aerosol-generating articles according to the invention comprising a mouthpiece element comprising a filter segment and a hollow tube, the hollow tube is preferably arranged at the distal end of the rod. The mouthpiece element may be extended in length, in particular through the addition or elongation of a hollow tube, in order to compensate a shortened length of the aerosol-cooling element such that a total length of the aerosol-generating article is kept at a predefined total length. Preferably, the total length of the article is 45 millimeter and the aerosol-cooling element of the tobacco element has a length of at most 15 millimeter. Thus, the length of the mouthpiece element, preferably the length of the hollow tube, is adapted according to the length of the aerosol-cooling element such that a total length of the aerosol-generating article is kept at a predefined total length.

The possibility of having a shortened aerosol-cooling element, the compensation of such a shortened aerosol-cooling element with the provision of an additional hollow tube in the mouthpiece element, its advantages and specific features have been described in detail in the European patent application No. 15173224.5. This application and its content relating to the above described length compensation is herewith incorporated by reference.

Preferably, the aerosol-generating article comprises five to six elements or segments.

The elements of the aerosol-forming article, for example the aerosol-forming substrate, the plug element and any other elements of the aerosol-generating article such as a support element, an aerosol-cooling element, and a mouthpiece element, are circumscribed by an outer wrapper. The outer wrapper may be formed from any suitable material or combination of materials. Preferably, the outer wrapper is a cigarette paper.

BRIEF DESCRIPTION OF THE DRAWINGS

The invention is further described with regard to embodiments, which are illustrated by means of the following drawings, wherein.

DETAILED DESCRIPTION

Figure 1:
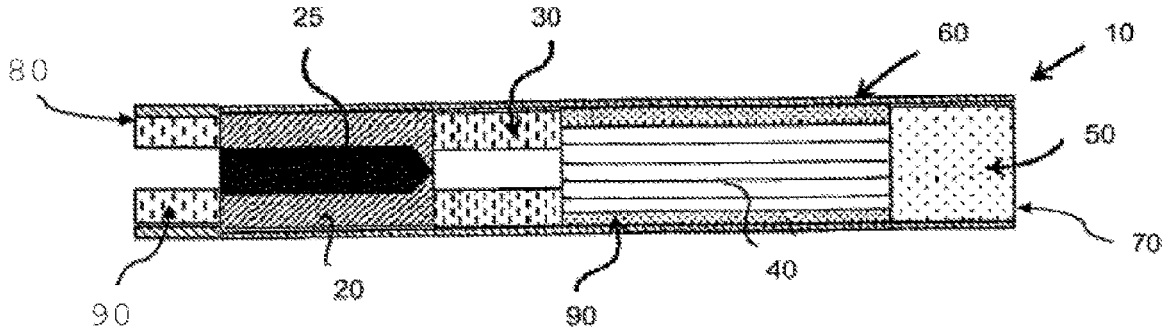
FIG. 1 is a schematic illustration of a cross-section of an embodiment of an aerosol-generating article with a plug element.

FIG. 1 illustrates an aerosol-generating article 10. The aerosol-generating article 10 comprises five elements arranged in coaxial alignment: a plug element 90, an aerosol-forming substrate 20, a support element 30, an aerosol-cooling element 40, and a mouthpiece 50. Each of these five elements is a substantially cylindrical element, each having substantially the same diameter. These five elements are arranged sequentially and are circumscribed by an outer wrapper 60 to form a cylindrical rod. A blade-shaped susceptor 25 is located within the aerosol-forming substrate, in contact with the aerosol-forming substrate. The susceptor 25 has a length that is approximately the same as the length of the aerosol-forming substrate, and is located along a radially central axis of the aerosol-forming substrate.

The susceptor 25 is a ferritic iron material having a length of 10 mm, a width of 3 mm and a thickness of 1 mm. One or both ends of the susceptor may be sharpened or pointed to facilitate insertion into the aerosol-forming substrate.

The aerosol-generating article 10 has a proximal or mouth end 70, which a user inserts into his or her mouth during use, and a distal end 80 located at the opposite end of the aerosol-generating article 10 to the mouth end 70. Once assembled, the total length of the aerosol-generating article 10 is about 47 mm to 53 mm and the diameter is about 7.2 mm.

In use air is drawn through the aerosol-generating article by a user from the distal end 80 to the mouth end 70. The distal end 80 of the aerosol-generating article may also be described as the upstream end of the aerosol-generating article 10 and the mouth end 70 of the aerosol-generating article 10 may also be described as the downstream end of the aerosol-generating article 10. Elements of the aerosol-generating article 10 located between the mouth end 70 and the distal end 80 can be described as being upstream of the mouth end 70 or, alternatively, downstream of the distal end 80.

The plug element 90 is located at the extreme distal or upstream end 80 of the aerosol-generating article 10. In FIG. 1, the plug element is shown as a hollow tube, for example a hollow cellulose acetate tube. The inner diameter of the hollow tube is the same or slightly smaller than the width of the susceptor 25 in order to prevent the susceptor from being dislodged out of the distal end of the aerosol-forming substrate 20.

The aerosol-forming substrate 20 is located immediately downstream of the plug element 90 in the aerosol-generating article 10. In FIG. 1, the aerosol-forming substrate 20 comprises a gathered sheet of crimped homogenised tobacco material circumscribed by a wrapper. The crimped sheet of homogenised tobacco material comprises glycerine as an aerosol-former.

The support element 30 is located immediately downstream of the aerosol-forming substrate 20 and abuts the aerosol-forming substrate 20. In FIG. 1, the support element 30 is a hollow cellulose acetate tube. The support element 30 locates the aerosol-forming substrate 20 in the aerosol-generating article 10. Thus, the support element 30 helps prevent the aerosol-forming substrate 20 from being forced downstream within the aerosol-generating article 10 towards the aerosol-cooling element 40, for example upon inserting the article into a device. The support element 30 also acts as a spacer to space the aerosol-cooling element 40 of the aerosol-generating article 10 from the aerosol-forming substrate 20.

The aerosol-cooling element 40 is located immediately downstream of the support element 30 and abuts the support element 30. In use, volatile substances released from the aerosol-forming substrate 20 pass along the aerosol-cooling element 40 towards the mouth end 70 of the aerosol-generating article 10. The volatile substances may cool within the aerosol-cooling element 40 to form an aerosol that is inhaled by the user. In FIG. 1, the aerosol-cooling element comprises a crimped and gathered sheet of polylactic acid circumscribed by a wrapper 90. The crimped and gathered sheet of polylactic acid defines a plurality of longitudinal channels that extend along the length of the aerosol-cooling element 40.

The mouthpiece 50 is located immediately downstream of the aerosol-cooling element 40 and abuts the aerosol-cooling element 40. In FIG. 1, the mouthpiece 50 comprises a conventional cellulose acetate tow filter of low filtration efficiency.

To assemble the aerosol-generating article 10, the five cylindrical elements described above are aligned and tightly wrapped within the outer wrapper 60. In FIG. 1, the outer wrapper is a conventional cigarette paper.

Upon manufacturing the article, the four elements without the plug element 90 may be assembled. The susceptor 25 is then inserted into the distal end 80 of the assembly such that it penetrates the aerosol-forming substrate 20. The plug element 80 is then aligned with the assembly and the five elements are then wrapped by the wrapper 60 to form the complete aerosol-generating article 10. As an alternative method of assembly, the susceptor 25 is inserted into the aerosol-forming substrate 20 prior to the assembly of the plurality of elements to form a rod.

The aerosol-generating article 10 of FIG. 1 is designed to engage with an electrically-operated aerosol-generating device comprising an induction coil, or inductor, in order to be smoked or consumed by a user.

Figure 2:
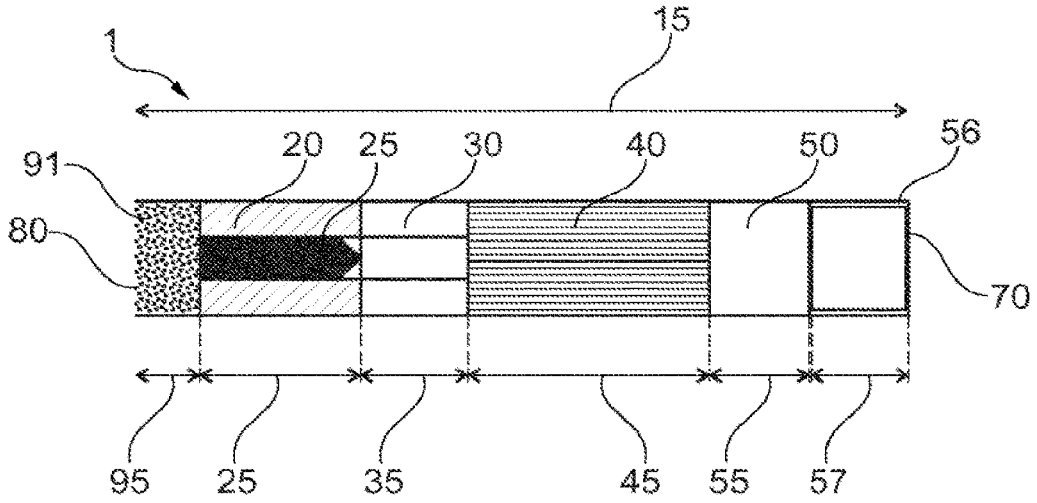
FIG. 2 is a schematic illustration of a cross-section of another embodiment of an aerosol-generating article with recessed filter.

FIG. 2 illustrates an aerosol-generating article 1 comprising six elements, wherein the same reference numbers are used for the same or similar elements. A plug element 91, an aerosol-forming substrate 20, a support element in the form of a hollow cellulose acetate tube 30, an aerosol-cooling element 40, a mouthpiece filter 50 and a cardboard tube 56 are arranged sequentially and in coaxial alignment and are assembled by a cigarette paper and by a tipping paper (not shown) to form a rod. The cardboard tube 56 is located at the mouth-end 70 of the aerosol-generating article 1 and the plug element 91 is located at the distal end 80 of the aerosol-generating article 1.

When assembled, the rod has a length 15 of for example 45 mm and has an outer diameter of about 7.2 millimeter.

The plug element 91 is a porous plug, for example of an open pored thermal resistant material. The plug element has a length 95 of 3 to 5 mm.

The aerosol-forming substrate 20 may comprise a bundle of crimped cast-leaf tobacco wrapped in a filter paper (not shown) to form a plug. The cast-leaf tobacco includes additives, including glycerine as an aerosol-forming additive. The length 25 of the aerosol-forming substrate is 12 millimeter. The length of the susceptor 25 is about 10 mm and pointed at its proximal end.

The hollow acetate tube 30 is located immediately downstream of the aerosol-forming substrate 20 and abuts the aerosol-forming substrate 2. The length 35 of the acetate tube 30 is 8 mm.

The aerosol-cooling element 40 has a length 45 of 10 mm to 13 mm and an outer diameter of about 7.12 mm. Preferably, the aerosol-cooling element 40 is formed from a sheet of polylactic acid having a thickness of 50 mm plus or minus 2 mm. The sheet of polylactic acid has been crimped and gathered defining a plurality of channels that extend along the length of the aerosol-cooling element 40. The total surface area of the aerosol-cooling element may be between 300 $mm^2$ per mm length and 1000 $mm^2$ per mm length or about 10 $mm^2$ per mg weight and 100 $mm^2$ per mg weight of the aerosol-cooling element 40.

The length 45 of the aerosol-cooling element 40 is 5 mm to 8 mm shorter than conventional aerosol-cooling elements of aerosol-generating articles having a standard length of 45 mm. The length of conventional aerosol-cooling elements of such standard length aerosol-generating articles, in particular those aerosol-cooling elements made of polylactic acid sheets, is 18 mm.

The mouthpiece filter 50 arranged downstream of the aerosol-cooling element 40 may be a conventional mouthpiece filter formed from cellulose acetate, and has a length 55 of 7 millimeter.

The cardboard tube 56 is the most downstream element of the aerosol-generating article 1 and has a length 57 of 3 mm to 5 millimeter. The cardboard tube together with the plug element 80 makes up for the shorter aerosol-cooling element 50 such that the total length of the aerosol-generating article is 45 mm. The cardboard tube 56 also provides a recessed mouth-end 70 of the aerosol-generating article, simulating the use of conventional cigarettes having recessed mouth-ends.

The reduced length of the aerosol-cooling element 40 may compensate the additional length 95 of the plug element 91 alone. The cardboard tube 56 may be provided optionally.

Figure 3:
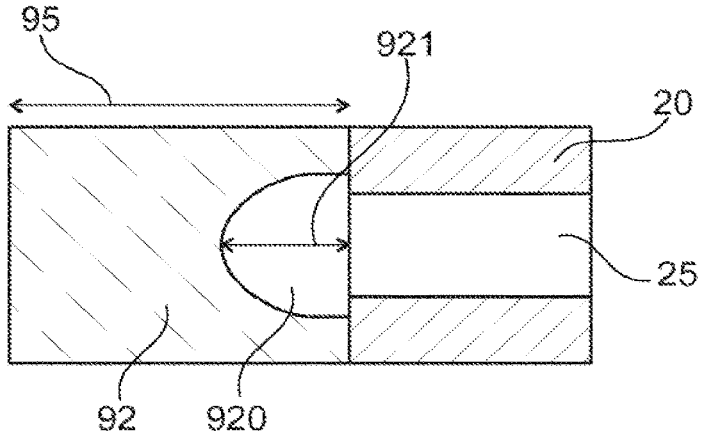
FIG. 3 shows an enlarged view of a plug element with cavity.

In FIG. 3, the plug element 92 comprises a cavity 920 with an open end directing to the aerosol-forming substrate 20. The cavity 920 is dome-shaped and has a maximum depth 921 between 25 percent and 50 percent of the length 95 of the plug element. If the plug element has a length 95 of 5 mm, the depth 921 of the cavity 920 is about 1 mm to 2.5 mm. The material of the plug element 92 is a heat resistant material withstanding temperatures of about 350 degree Celsius. Preferably, the plug element is porous allowing air to pass through the plug element 92.

Figure 4:
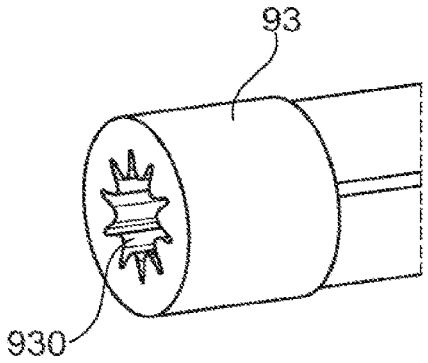
FIG. 4 shows another embodiment of a plug element.

FIG. 4 illustrates an embodiment of a plug element 93 having a longitudinally arranged opening 930 in the plug element for air to pass through the plug element. The material of the plug element may otherwise be gas-tight. The opening 930 has an irregular star-shaped cross section, which may serve for marking purposes and may add to a pleasant appearance of the aerosol-generating article.

The invention claimed is:

1. An aerosol-generating article comprising:

a plurality of elements assembled in the form of a rod having a mouth end and a distal end upstream from the mouth end, the plurality of elements comprising an aerosol-forming substrate with an elongate susceptor arranged longitudinally within the aerosol-forming substrate, wherein a plug element comprising a hollow tube is located upstream of and adjacent the aerosol-forming substrate and the elongate susceptor within the rod to prevent the elongate susceptor from dislodging from the aerosol-forming substrate, the plug element preventing direct physical contact with a distal end of the elongate susceptor arranged longitudinally within the aerosol-forming substrate, wherein an inner diameter of the hollow tube is smaller than a width of the elongate susceptor, and wherein the plug element has a resistance to draw (RTD) that does not exceed 30 mm WG.

2. The aerosol-generating article according to claim 1, wherein the resistance to draw (RTD) of the plug element is between 20 mmWG and 30 mmWG.

3. The aerosol-generating article according to claim 1, wherein the resistance to draw (RTD) of the plug element is between 1 mmWG to 5 mmWG per millimetre length of the plug element.

4. The aerosol-generating article according to claim 1, wherein the plug element is porous.

5. The aerosol-generating article according to claim 4, wherein the plug element has a porosity between 50 and 90 percent.

6. The aerosol-generating article according to claim 1, wherein the plug element is made of ceramic, polymeric material, cellulose acetate, cardboard, non- inductively heatable metal, zeolite, or aerosol-forming substrate.

7. The aerosol-generating article according to claim 1, wherein the plug element is gas-tight.

8. The aerosol-generating article according to claim 1, wherein at least the distal end of the plug element has a homogeneous structure.

9. The aerosol-generating article according to claim 1, wherein the plug element is made of a heat resistant material.

10. The aerosol-generating article according to claim 1, wherein the plug element has a length of between 3 millimeters to 5 millimeters.

11. The aerosol-generating article according to claim 1, wherein the aerosol-forming substrate comprises one or more sheets of homogenised tobacco material.

12. The aerosol-generating article according to claim 1, wherein the elongate susceptor has a same length as the aerosol-forming substrate.

13. The aerosol-generating article according to claim 1, wherein the elongate susceptor has a width of between 1 mm and 5 mm.

14. The aerosol-generating article according to claim 1, wherein the elongate susceptor has a thickness of between 10 micrometers and 500 micrometers.

15. The aerosol-generating article according to claim 1, wherein the elongate susceptor comprises a first susceptor material and a second susceptor material, wherein the first and second susceptor materials have first and second Curie temperatures that are distinct from one another.

16. The aerosol-generating article according to claim 15, wherein the first susceptor material has a first Curie temperature that is above 500° C. and the second susceptor material has a second Curie temperature that is lower than 500° C.

17. The aerosol-generating article according to claim 1, wherein the plurality of elements further comprises a support element, an aerosol-cooling element, and a mouthpiece element.

18. The aerosol-generating article according to claim 17, wherein the aerosol-cooling element has a length of at most 15 millimeters.

19. The aerosol-generating article according to claim 17, wherein the mouthpiece element comprises a filter segment and a hollow tube arranged at the downstream end of the mouthpiece element.

20. The aerosol-generating article according to claim 1, wherein the plug element has a diameter of between 5 and 10 millimeters.

21. The aerosol-generating article according to claim 1, wherein the aerosol-forming substrate comprises a non-tobacco material.

* * * * *